US010734720B2

(12) United States Patent
Wen et al.

(10) Patent No.: US 10,734,720 B2
(45) Date of Patent: Aug. 4, 2020

(54) ANTENNA AND COMMUNICATIONS DEVICE

(71) Applicant: HUAWEI TECHNOLOGIES CO., LTD., Shenzhen, Guangdong (CN)

(72) Inventors: Geyi Wen, Nanjing (CN); Ming Zhang, Hangzhou (CN)

(73) Assignee: HUAWEI TECHNOLOGIES CO., LTD., Shenzhen, Guangdong (CN)

( * ) Notice: Subject to any disclaimer, the term of this patent is extended or adjusted under 35 U.S.C. 154(b) by 122 days.

(21) Appl. No.: 16/021,318

(22) Filed: Jun. 28, 2018

(65) Prior Publication Data

US 2018/0316088 A1 Nov. 1, 2018

Related U.S. Application Data

(63) Continuation of application No. PCT/CN2016/107785, filed on Nov. 29, 2016.

(30) Foreign Application Priority Data

Dec. 29, 2015 (CN) ..... 2015 1 1024590

(51) Int. Cl.
*H01Q 1/48* (2006.01)
*H01Q 1/52* (2006.01)
(Continued)

(52) U.S. Cl.
CPC ..... *H01Q 1/521* (2013.01); *H01Q 1/38* (2013.01); *H01Q 1/48* (2013.01); *H01Q 1/50* (2013.01);
(Continued)

(58) Field of Classification Search
CPC ..... H01G 1/521; H01G 5/371; H01G 1/38; H01G 1/48; H01G 1/50; H01G 9/42; H01G 21/28
See application file for complete search history.

(56) References Cited

U.S. PATENT DOCUMENTS

2011/0116404 A1 5/2011 Shimizu
2011/0298666 A1* 12/2011 Kim ..... H01Q 1/243 343/700 MS
(Continued)

FOREIGN PATENT DOCUMENTS

CN 202058854 U 11/2011
CN 102334236 A 1/2012
(Continued)

OTHER PUBLICATIONS

Extended European Search Report for European Application No. 16880853.3 dated Dec. 4, 2018.
(Continued)

*Primary Examiner* — Graham P Smith
(74) *Attorney, Agent, or Firm* — Womble Bond Dickinson (US) LLP

(57) ABSTRACT

Embodiments of the present invention provide an antenna and a communications device. The antenna of the present invention includes a plurality of antenna units. Each antenna unit includes a plurality of antenna branches and one feed branch. Different antenna branches in a same antenna unit correspond to different frequency bands. At least one antenna unit pair exists in the plurality of antenna units. A distance between two antenna units in each antenna unit pair is less than a first preset distance. Radiation directions of antenna branches in each antenna unit pair that correspond to a same frequency band are different. By means of the present invention, isolation between the antenna units in the antenna can be increased.

11 Claims, 10 Drawing Sheets

(51) Int. Cl.

| | |
|---|---|
| ***H01Q 5/371*** | (2015.01) |
| ***H01Q 9/42*** | (2006.01) |
| ***H01Q 21/28*** | (2006.01) |
| ***H01Q 1/50*** | (2006.01) |
| ***H01Q 1/38*** | (2006.01) |

(52) U.S. Cl.
CPC ..... *H01Q 5/371* (2015.01); *H01Q 9/42* (2013.01); *H01Q 21/28* (2013.01)

(56) References Cited

U.S. PATENT DOCUMENTS

| | | | |
|---|---|---|---|
| 2012/0127038 | A1 | 5/2012 | Kim et al. |
| 2013/0069842 | A1 | 3/2013 | Lee et al. |

FOREIGN PATENT DOCUMENTS

| | | | |
|---|---|---|---|
| CN | 102394348 | A | 3/2012 |
| CN | 102832452 | A | 12/2012 |
| CN | 104505590 | A | 4/2015 |
| CN | 104538731 | A | 4/2015 |
| CN | 204375949 | U | 6/2015 |
| CN | 204760533 | U | 11/2015 |
| EP | 2323217 | A1 | 5/2011 |
| JP | 2006-319767 | A | 11/2006 |
| JP | 2011-109440 | A | 6/2011 |
| JP | 2013-026759 | A | 2/2013 |
| KR | 1020120035459 | A | 4/2012 |
| KR | 101144518 61 | | 5/2012 |
| WO | 2012008946 | A1 | 1/2012 |
| WO | 2013/175903 | A1 | 11/2013 |

OTHER PUBLICATIONS

Muhammad U. Khan et al., "A Compact 8-Element MIMO Antenna System for 802.11ac WLAN Applications," 2013 International Workshop on Antenna Technology (iWAT), pp. 91-94.

International Search Report, dated Feb. 17, 2017, in International Application No. PCT/CN2016/107785 (4 pp.).

International Search Report dated Feb. 17, 2017 in corresponding International Patent Application No. PCT/CN2016/107785.

LingSheng Yang et al.,"Four-Element Dual-Band MIMO Antenna System for Mobile Phones",Progress in Electromagnetics Research C, vol. 47-56 Jan. 2015, total 10 pages.

Lingsheng Yang et al., "Box-folded four-element MIMO antenna system for LTE handsets",Electronics Letters Mar. 19, 2015 vol. 51 No. 6 pp. 440 441, total 2 pages.

* cited by examiner

ANTENNA AND COMMUNICATIONS DEVICE

CROSS-REFERENCE TO RELATED APPLICATIONS

This application is a continuation of International Application No. PCT/CN2016/107785, filed on Nov. 29, 2016, which claims priority to Chinese Patent Application No. 201511024590.2, filed on Dec. 29, 2015. The disclosures of the aforementioned applications are hereby incorporated by reference in their entireties.

TECHNICAL FIELD

Embodiments of the present invention relate to communications technologies, and in particular, to an antenna and a communications device.

BACKGROUND

To improve a channel capacity and communication quality of a communications device, a conventional single-input single-output (Single-Input Single-Output, SISO for short) antenna in the communications device may be replaced with a multiple-input multiple-output (Multiple-Input Multiple-Output, MIMO for short) antenna. Compared with the conventional SISO antenna that has one antenna unit, the MIMO antenna may include a plurality of antenna units. The MIMO antenna receives and transmits information by using the plurality of antenna units, so that the channel capacity and the communication quality can be improved.

In the MIMO antenna, mutual coupling between the plurality of antenna units causes mutual interference between the plurality of antenna units. To avoid the interference between the antenna units, a distance between the antenna units may be made greater than a preset distance, thereby implementing decoupling between the plurality of antenna units. However, as sizes of antennas are becoming smaller, the distance between the antenna units is restricted, and consequently, the coupling between the antenna units cannot be eliminated. In a common MIMO antenna, for a fixed frequency band, a neutralization line corresponding to the fixed frequency band may be disposed between neighboring antenna units in the plurality of antenna units, so as to neutralize a coupling current between the neighboring antenna units by using the neutralization line, thereby implementing decoupling of the antenna units. With development of multiband multimode communications, a MIMO antenna supporting multiband multimode communications emerges. That is, the MIMO antenna can support a plurality of frequency bands.

However, a problem of coupling between antenna units of the MIMO antenna supporting a plurality of frequency bands still cannot be resolved.

SUMMARY

Embodiments of the present invention provide an antenna and a communications device, to resolve a problem of coupling between antenna units of a MIMO antenna supporting a plurality of frequency bands, thereby increasing isolation between the antenna units.

An embodiment of the present invention provides an antenna, including: a plurality of antenna units, where each antenna unit includes a plurality of antenna branches and one feed branch; the plurality of antenna branches are all connected to the feed branch; and different antenna branches in a same antenna unit correspond to different frequency bands; and at least one antenna unit pair exists in the plurality of antenna units, a distance between two antenna units in each antenna unit pair is less than a first preset distance, and radiation directions of antenna branches in each antenna unit pair that correspond to a same frequency band are different.

Optionally, the antenna further includes a substrate; the substrate has a first surface; and the plurality of antenna units are located at edge positions of the first surface.

Optionally, the antenna further includes a ground plate; the substrate further has a second surface; the second surface is parallel to the first surface; and the ground plate is located on the second surface; and one end of the feed branch has a feed point, and another end has a ground point; and ground points of all the antenna units are connected to the ground plate.

Optionally, the ground plate has a clearance area of each antenna unit; and the clearance area of each antenna unit is located in a projection area of the antenna unit on the ground plate.

The clearance area that is on the ground plate of the antenna and that corresponds to each antenna unit can increase radiation efficiency and radiation bandwidth of the antenna branches in the antenna unit.

Optionally, a projection direction of each antenna unit on the ground plate is used as a vertical direction, and a minimum horizontal distance between a boundary that is of the feed branch in each antenna unit and that is away from the antenna branch and a boundary of the clearance area of the antenna unit is 0; and a minimum horizontal distance between a boundary that is of the antenna branch in each antenna unit and that is close to the feed point and a boundary of the clearance area of the antenna unit is $\lambda/50$.

Optionally, if a distance between ground points of two neighboring antenna units in the plurality of antenna units is less than or equal to $\lambda/12$, the ground plate further has a clearance area corresponding to a separation area between the two neighboring antenna units, where the clearance area corresponding to the separation area is a projection area of the separation area on the ground plate.

Optionally, the first preset distance is $\lambda/2$, and $\lambda$ is a wavelength corresponding to a lowest frequency in a lowest frequency band corresponding to each antenna unit.

Optionally, the distance between the two antenna units in each antenna unit pair is greater than or equal to $\lambda/4$ and less than $\lambda/2$.

Optionally, the radiation directions of the antenna branches in each antenna unit pair that correspond to the same frequency band are opposite.

Optionally, if a distance between neighboring antenna branches in a same antenna unit is less than a second preset distance, different antenna branches in the neighboring antenna branches further correspond to a common frequency band; and the common frequency band is different from a frequency band corresponding to each antenna branch in the neighboring antenna branches, where the second preset distance is a coupling distance corresponding to antenna branches in the same antenna unit that correspond to different frequency bands.

If the distance between the neighboring antenna branches in the same antenna unit is less than the second preset distance, different antenna branches in the neighboring antenna branches not only correspond to different frequency bands, but also may further correspond to the common frequency band. This can increase a frequency band width corresponding to the neighboring antenna branches in the antenna unit, thereby increasing signal transmission bandwidth of the antenna.

An embodiment of the present invention further provides a communications device, including an antenna, where the antenna includes a plurality of antenna units, where each antenna unit includes a plurality of antenna branches and one feed branch; the plurality of antenna branches are all connected to the feed branch; different antenna branches in a same antenna unit correspond to different frequency bands; at least one antenna unit pair exists in the plurality of antenna units; a distance between two antenna units in each antenna unit pair is less than a first preset distance; and radiation directions of antenna branches in each antenna unit pair that correspond to a same frequency band are different.

Optionally, the communications device further includes a radio frequency processing unit and a baseband processing unit, where the baseband processing unit is connected to the feed branch by using the radio frequency processing unit;

the antenna is configured to: transmit a received radio signal to the radio frequency processing unit, or convert a signal transmitted by the radio frequency processing unit into an electromagnetic wave, and send the electromagnetic wave out;

the radio frequency processing unit is configured to: perform frequency selection, amplification, and down-conversion processing on the radio signal received by the antenna, convert the processed radio signal into an intermediate-frequency signal or a baseband signal, and send the intermediate-frequency signal or the baseband signal to the baseband processing unit; or is configured to: perform up-conversion and amplification on a baseband signal or an intermediate-frequency signal sent by the baseband processing unit, and send the amplified baseband signal or intermediate-frequency signal out by using the antenna; and the baseband processing unit is configured to process the intermediate-frequency signal or the baseband signal sent by the radio frequency processing unit.

Optionally, the antenna further includes a substrate; the substrate has a first surface; and the plurality of antenna units are located at edge positions of the first surface.

Optionally, the antenna further includes a ground plate; the substrate further has a second surface; the second surface is parallel to the first surface; and the ground plate is located on the second surface; and one end of the feed branch has a feed point, and another end has a ground point; and ground points of all the antenna units are connected to the ground plate.

Optionally, the ground plate has a clearance area of each antenna unit; and the clearance area of each antenna unit is located in a projection area of the antenna unit on the ground plate.

Optionally, a projection direction of each antenna unit on the ground plate is used as a vertical direction, and a minimum horizontal distance between a boundary that is of the feed branch in each antenna unit and that is away from the antenna branch and a boundary of the clearance area of the antenna unit is 0; and a minimum horizontal distance between a boundary that is of the antenna branch in each antenna unit and that is close to the feed point and a boundary of the clearance area of the antenna unit is $\lambda/50$.

Optionally, if a distance between ground points of two neighboring antenna units in the plurality of antenna units is less than or equal to $\lambda/12$, the ground plate further has a clearance area corresponding to a separation area between the two neighboring antenna units, where the clearance area corresponding to the separation area is a projection area of the separation area on the ground plate.

Optionally, the first preset distance is $\lambda/2$, and $\lambda$ is a wavelength corresponding to a lowest frequency in a lowest frequency band corresponding to each antenna unit.

Optionally, the distance between the two antenna units in each antenna unit pair is greater than or equal to $\lambda/4$ and less than $\lambda/2$.

Optionally, the radiation directions of the antenna branches in each antenna unit pair that correspond to the same frequency band are opposite.

Optionally, if a distance between neighboring antenna branches in a same antenna unit is less than a second preset distance, different antenna branches in the neighboring antenna branches further correspond to a common frequency band; and the common frequency band is different from a frequency band corresponding to each antenna branch in the neighboring antenna branches, where the second preset distance is a coupling distance corresponding to antenna branches in the same antenna unit that correspond to different frequency bands.

If the distance between the neighboring antenna branches in the same antenna unit in the antenna of the communications device is less than the second preset distance, different antenna branches in the neighboring antenna branches not only correspond to different frequency bands, but also may further correspond to the common frequency band. This can increase a frequency band width corresponding to the neighboring antenna branches in the antenna unit, thereby increasing signal transmission bandwidth of the antenna in the communications device.

For the antenna and the communications device in the embodiments of the present invention, the antenna includes a plurality of antenna units, where each antenna unit includes a plurality of antenna branches and one feed branch; the plurality of antenna branches are all connected to the feed branch; different antenna branches in a same antenna unit correspond to different frequency bands; at least one antenna unit pair exists in the plurality of antenna units; a distance between feed points of two antenna units in each antenna unit pair is less than a preset distance; and radiation directions of antenna branches in each antenna unit pair that correspond to a same frequency band are different. The plurality of antenna branches in a same antenna unit respectively support different frequency bands, and when the distance between the feed points of the two antenna units is less than the first preset distance, radiation directions of antenna branches that are in the two antenna units and that correspond to a same frequency band are different. Therefore, by means of the embodiments of the present invention, when a distance between antenna units is less than a preset distance, coupling between antenna units of a MMO antenna supporting a plurality of frequency bands can be reduced, interference between the antenna units can be reduced, and isolation between the antenna units can be increased.

BRIEF DESCRIPTION OF DRAWINGS

To describe the technical solutions in the embodiments of the present invention more clearly, the following briefly describes the accompanying drawings required for describing the embodiments or the prior art. Apparently, the accompanying drawings in the following description show some embodiments of the present invention, and a person of ordinary skill in the art may still derive other drawings from these accompanying drawings without creative efforts.

DESCRIPTION OF REFERENCE NUMERALS

100, 500, 600, 700, 800, 900, 1001: Antenna;
101: Antenna unit;
102: Antenna branch;
103, 511, 611, 711, 811, 915: Feed branch;
201, 505, 605, 705, 805, 909: Substrate;
202, 507, 607, 707, 807, 911: First surface;
301, 506, 606, 706, 806, 910: Ground plate;
302, 508, 608, 708, 808, 912: Second surface;
303, 512, 612, 712, 812, 916: Feed point;
304, 513, 613, 713, 813, and 917: Ground point;
401, 514, 614, 714, 814, 918: Clearance area;
402, 403, 404, 405: Boundary;
501, 601, 701, 801, 901: First antenna unit;
502, 602, 702, 802, 902: Second antenna unit;
503, 603, 703, 803, 903: Third antenna unit;
504, 604, 704, 804, 904: Fourth antenna unit;
509, 609, 709, 809, 913: First antenna branch;
510, 610, 710, 810, 914: Second antenna branch;
905: Fifth antenna unit;
906: Sixth antenna unit;
907: Seventh antenna unit;
908: Eighth antenna unit;
1000: Communications device;
1101: Radio frequency processing unit; and
1102: Baseband processing unit.

DESCRIPTION OF EMBODIMENTS

To make the objectives, technical solutions, and advantages of the embodiments of the present invention clearer, the following clearly describes the technical solutions in the embodiments of the present invention with reference to the accompanying drawings in the embodiments of the present invention. Apparently, the described embodiments are some but not all of the embodiments of the present invention. All other embodiments obtained by a person of ordinary skill in the art based on the embodiments of the present invention without creative efforts shall fall within the protection scope of the present invention.

An antenna provided in each embodiment of the present invention may be a MIMO antenna supporting a plurality of frequency bands. The MIMO antenna may be located in a communications device. The communications device may be a wireless communications device. For example, the communications device may be any one of a terminal, a network device, or a relay device. The terminal may be, for example, a notebook computer, a smartphone, or a tablet computer. The network device may be, for example, a base station or a gateway.

Figure 1A:
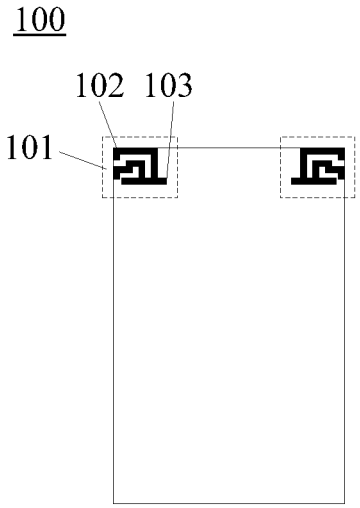
FIG. 1A is a schematic structural diagram of an antenna according to Embodiment 1 of the present invention.
Figure 1B:
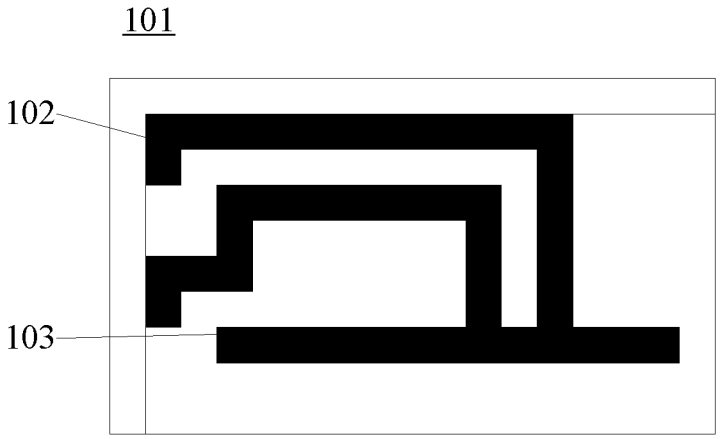
FIG. 1B is a schematic structural diagram of an antenna unit in the antenna according to Embodiment 1 of the present invention.

Embodiment 1 of the present invention provides an antenna. FIG. 1A is a schematic structural diagram of an antenna according to Embodiment 1 of the present invention. FIG. 1B is a schematic structural diagram of an antenna unit in the antenna according to Embodiment 1 of the present invention. As shown in FIG. 1A and FIG. 1B, the antenna 100 may include a plurality of antenna units 101. Each antenna unit 101 includes a plurality of antenna branches 102 and one feed branch 103. The plurality of antenna branches 102 are all connected to the feed branch 103. Each antenna unit 101 may be an antenna unit of a microstrip structure, that is, the antenna branches 102 and the feed branch 103 included in each antenna unit 101 may all be of a microstrip structure.

Different antenna branches 102 in a same antenna unit 101 correspond to different frequency bands. Different antenna branches 102 in a same antenna unit 101 correspond to different frequency bands. That is, in a same antenna unit 101, each antenna branch 102 corresponds to one frequency band, and different antenna branches 102 correspond to different frequency bands. Because different antenna branches 102 correspond to different frequency bands, frequency bands that can be supported by the different antenna branches 102 are different, that is, frequency bands corresponding to signals that are sent or received by the different antenna branches 102 are different. Each antenna branch 102 supports a signal that is in a frequency band corresponding to the antenna branch 102, that is, can send or receive a signal that is in a frequency band corresponding to the antenna branch 102. A branch length of each antenna branch 102 in each antenna unit 101 may be determined based on the frequency band corresponding to the antenna branch 102. For example, the branch length of each antenna branch 102 may be one quarter of a wavelength corresponding to a minimum frequency in the frequency band corresponding to the antenna branch 102.

The antenna 100 includes a plurality of antenna units 101, each antenna unit 101 includes a plurality of antenna branches 102, and different antenna branches 102 in a same antenna unit 101 correspond to different frequency bands. Therefore, each antenna unit 101 supports a plurality of frequency bands, and the plurality of frequency bands include the frequency bands corresponding to the antenna branches 102 in each antenna unit 101. Therefore, the antenna 100 may be a MIMO antenna supporting a plurality of frequency bands.

Internal structures of different antenna units 101 are the same, quantities of antenna branches 102 included in different antenna units 101 are the same, and a frequency band corresponding to an antenna branch 102 in one antenna unit 101 may be the same as a frequency band corresponding to an antenna branch 102 in another antenna unit 101. For example, if an antenna unit includes two antenna branches, with one antenna branch corresponding to a frequency band B39 and the other antenna branch corresponding to a frequency band B38 or a frequency band B40, another antenna unit also includes two antenna branches, with one antenna branch corresponding to the frequency band B39 and the other antenna branch corresponding to the frequency band B38 or the frequency band B40. The frequency band B38 is 2570 MHz to 2620 MHz. The frequency band B39 is 1880 MHz to 1920 MHz. The frequency band B40 is 2300 MHz to 2400 MHz.

At least one antenna unit pair exists in the plurality of antenna units 101, a distance between two antenna units 101 in each antenna unit pair is less than a first preset distance, and radiation directions of antenna branches 102 in each antenna unit pair that correspond to a same frequency band are different. The first preset distance is a preset distance between different antenna units 101.

For example, if one antenna unit pair exists in the plurality of antenna units, the antenna unit pair includes two antenna units, and the two antenna units each have two antenna branches, with one antenna branch corresponding to the frequency band B39 and the other antenna branch corresponding to the frequency band B38 or the frequency band B40. A radiation direction of the antenna branch corresponding to the frequency band B39 in one antenna unit in the antenna unit pair is different from that of the antenna branch corresponding to the frequency band B39 in the other antenna unit in the antenna unit pair.

The first preset distance may be, for example, determined based on a maximum coupling distance between two neighboring antenna units, and the first preset distance may be less than the maximum coupling distance. Therefore, if a distance between two antenna units is greater than or equal to the first preset distance, no coupling current exists between the two antenna units, or a coupling current between the two antenna units falls within a preset coupling current range. In an existing antenna unit coupling solution, if a distance between two antenna units is less than the first preset distance, a coupling current inevitably exists between the two antenna units. In the antenna provided in this embodiment of the present invention, if a distance between two antenna units is less than the first preset distance, coupling between the two antenna units can be reduced or even eliminated because radiation directions of antenna branches that are in the two antenna units and that correspond to a same frequency band are different. That radiation directions of antenna branches that are in the two antenna units and that correspond to a same frequency band are different includes: an angle difference between the radiation directions of the antenna branches that are in the two antenna units and that correspond to the same frequency band is 90° or 180°.

The antenna provided in Embodiment 1 of the present invention may include a plurality of antenna units, where each antenna unit includes a plurality of antenna branches and one feed branch; the plurality of antenna branches are all connected to the feed branch; different antenna branches in a same antenna unit correspond to different frequency bands; at least one antenna unit pair exists in the plurality of antenna units; a distance between two antenna units in each antenna unit pair is less than a first preset distance; and radiation directions of antenna branches in each antenna unit pair that correspond to a same frequency band are different. The first preset distance is a preset distance between different antenna units. Therefore, by means of this embodiment of the present invention, coupling between antenna units of a MIMO antenna supporting a plurality of frequency bands can be reduced, interference between the antenna units can be reduced, and isolation between the antenna units can be increased.

When the isolation between the antenna units is increased, transmission efficiency of antenna branches of the antenna units is also inevitably improved. Therefore, by means of this embodiment of the present invention, the transmission efficiency of the antenna branches of the antenna units in the antenna can also be improved, thereby improving transmission efficiency of the antenna.

By means of the antenna in this embodiment of the present invention, a problem of coupling between the antenna units can also be resolved if a distance between feed points of the two antenna units in each antenna unit pair is less than the first preset distance, and the antenna unit may be an antenna unit of a microstrip structure. Therefore, the antenna provided in this embodiment of the present invention may further be a low-profile antenna, and a size of the antenna can be reduced because no additional decoupling network is needed. This increases an integration level of components in a communications device, thereby reducing a size of the communications device.

In addition, in the antenna provided in this embodiment of the present invention, different antenna branches of the antenna unit may correspond to different frequency bands and are not limited to a narrow band. Therefore, if a distance between feed points of two antenna units is less than the first preset distance, high isolation between different antenna units for a plurality of frequency bands can be implemented provided that radiation directions of antenna branches that are in the two antenna units and that correspond to a same frequency band are different. Therefore, high isolation of the antenna in this embodiment of the present invention is not limited by the frequency band.

It should be noted that although two antenna units are shown in FIG. 1A and FIG. 1B, a quantity of antenna units in the antenna provided in Embodiment 1 of the present invention is not limited thereto. In addition, a shape of the antenna branch of each antenna unit in FIG. 1A and FIG. 1B is not limited herein, and may be another layout shape. Details are not described herein in the present invention.

Figure 2:
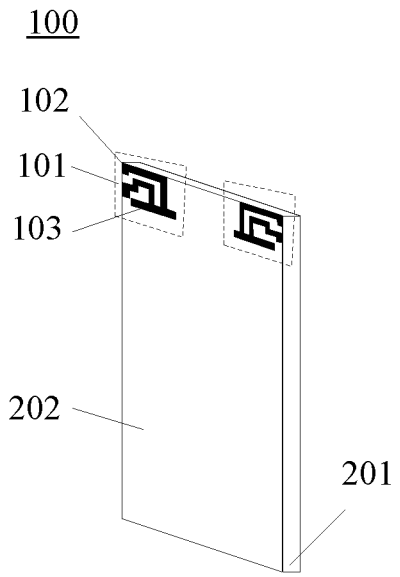
FIG. 2 is a schematic structural diagram of an antenna according to Embodiment 2 of the present invention.

Embodiment 2 of the present invention further provides an antenna. FIG. 2 is a schematic structural diagram of an antenna according to Embodiment 2 of the present invention. As shown in FIG. 2, based on the foregoing Embodiment 1, the antenna 100 may further include a substrate 201. The substrate 201 has a first surface 202. The plurality of antenna units 101 are located at edge positions of the first surface 202.

The plurality of antenna branches 102 and the feed branch 103 are laid on the first surface 202.

Figure 3A:
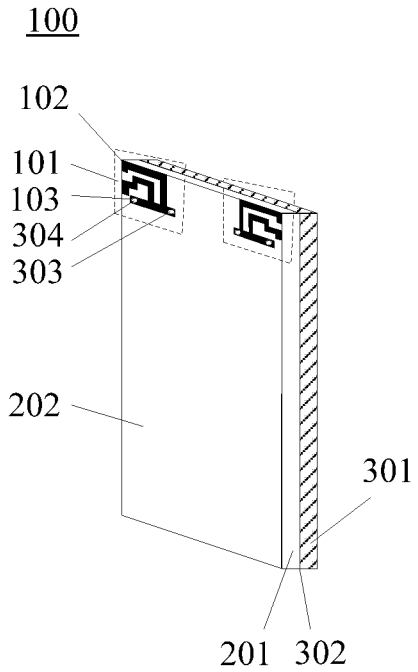
FIG. 3A is a schematic structural diagram of another antenna according to Embodiment 2 of the present invention.
Figure 3B:
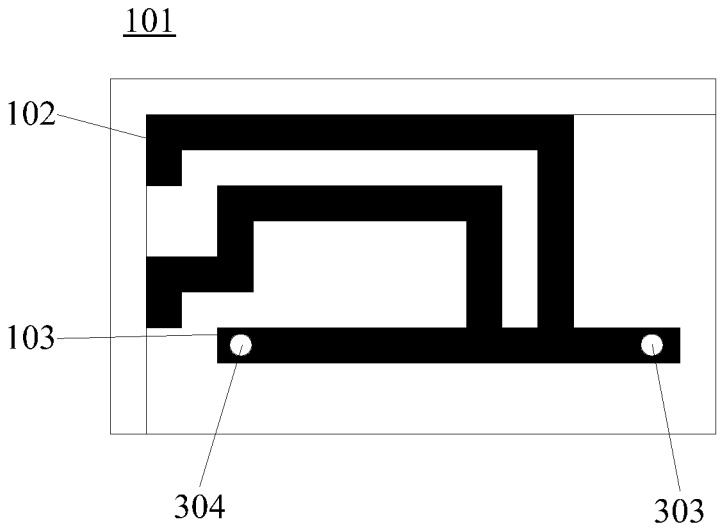
FIG. 3B is a schematic structural diagram of an antenna unit in the another antenna according to Embodiment 2 of the present invention.

FIG. 3A is a schematic structural diagram of another antenna according to Embodiment 2 of the present invention. FIG. 3B is a schematic structural diagram of an antenna unit in the another antenna according to Embodiment 2 of the present invention. As shown in FIG. 3A and FIG. 3B, based on the foregoing antenna, the antenna may further include a ground plate 301. The substrate 201 further has a second surface 302. The second surface 302 is parallel to the first surface 202. The ground plate 301 is located on the second surface 302.

One end of the feed branch 103 has a feed point 303, and another end has a ground point 304. Ground points 304 of all the antenna units 101 are connected to the ground plate 301.

Feed points 303 of all the antenna units 101 may further be connected to a feed circuit. The feed circuit may be a feed circuit in a communications device.

Specifically, a distance between two antenna units 101 in each antenna unit pair may be a distance between feed points of the two antenna units 101.

Optionally, in the foregoing embodiments, the first preset distance may be $\lambda/2$, and $\lambda$ is a wavelength corresponding to a lowest frequency in a lowest frequency band corresponding to each antenna unit.

For example, if each antenna unit 101 includes two antenna branches 102, a frequency band corresponding to one antenna branch 102 includes a frequency band B39, and a frequency band corresponding to the other antenna branch 102 includes frequency bands B38 B40, $\lambda$ may be a wavelength corresponding to a lowest frequency in a lowest frequency band.

Optionally, the distance between the feed points 303 of the two antenna units 101 in each antenna unit pair is greater than or equal to $\lambda/4$ and less than $\lambda/2$.

Optionally, the radiation directions of the antenna branches 102 in each antenna unit pair that correspond to the same frequency band are opposite.

Specifically, if the radiation directions of the antenna branches 102 in the antenna unit pair that correspond to the same frequency band are opposite, an angle difference between the radiation directions of the antenna branches 102 that are in the two antenna units 101 in the antenna unit pair and that correspond to the same frequency band is 180°.

Figure 4A:
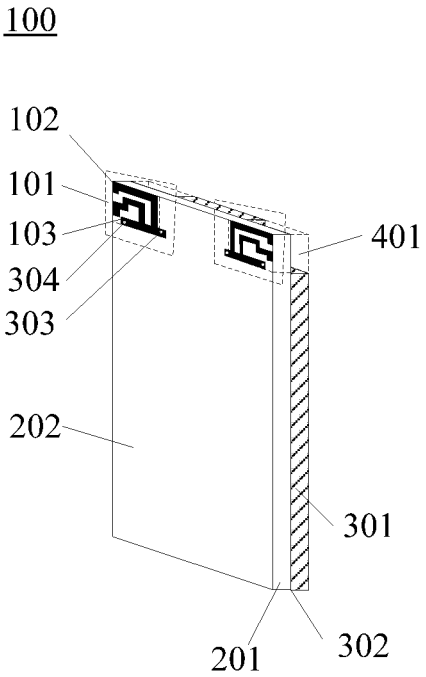
FIG. 4A is a schematic structural diagram of still another antenna according to Embodiment 2 of the present invention.
Figure 4B:
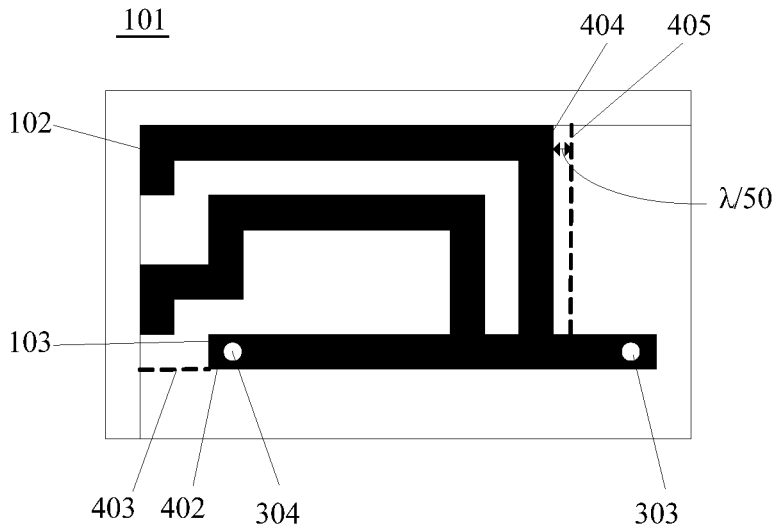
FIG. 4B is a schematic structural diagram of an antenna unit in the still another antenna according to Embodiment 2 of the present invention.

FIG. 4A is a schematic structural diagram of still another antenna according to Embodiment 2 of the present invention. FIG. 4B is a schematic structural diagram of an antenna unit in the still another antenna according to Embodiment 2 of the present invention. As shown in FIG. 4A and FIG. 4B, optionally, the ground plate 301 has a clearance area 401 of each antenna unit 101; and the clearance area 401 of each antenna unit 101 is located in a projection area of the antenna unit 101 on the ground plate 301.

Specifically, the clearance area 401 of each antenna unit 101 on the ground plate 301 is actually a clearance ground.

Disposing the clearance area of each antenna unit 101 on the ground plate 301 can increase radiation efficiency and radiation bandwidth of the antenna branches in the antenna unit.

Optionally, a projection direction of each antenna unit 101 on the ground plate 301 is used as a vertical direction, and a minimum horizontal distance between a boundary 402 that is of the feed branch 103 in each antenna unit 101 and that is away from the antenna branch 102 and a boundary 403 of the clearance area 401 of the antenna unit 101 is 0. A minimum horizontal distance between a boundary 404 that is of the antenna branch 102 in each antenna unit 101 and that is close to the feed point 303 and a boundary 405 of the clearance area 401 of the antenna unit 101 is $\lambda/50$.

If a distance between ground points 304 of two neighboring antenna units 101 in the plurality of antenna units 101 is less than or equal to $\lambda/12$, the ground plate 301 further has a clearance area corresponding to a separation area between the two neighboring antenna units 101. The clearance area corresponding to the separation area is a projection area of the separation area on the ground plate 301.

Optionally, if a distance between neighboring antenna branches 102 in a same antenna unit 101 is less than a second preset distance, different antenna branches in the neighboring antenna branches 102 further correspond to a common frequency band; and the common frequency band is different from a frequency band corresponding to each antenna branch in the neighboring antenna branches 102.

The second preset distance is a coupling distance corresponding to antenna branches 102 in the same antenna unit 101 that correspond to different frequency bands.

If the distance between the neighboring antenna branches 102 in the same antenna unit 101 is less than the second preset distance, different antenna branches in the neighboring antenna branches 102 not only correspond to different frequency bands, but also may further correspond to the common frequency band. This can increase a frequency band width corresponding to the neighboring antenna branches in the antenna unit, thereby increasing signal transmission bandwidth of the antenna.

In the antenna provided in Embodiment 2 of the present invention, because the distance between the feed points of the two antenna units in each antenna unit pair is greater than or equal to $\lambda/4$ and less than $\lambda/2$, coupling between the antenna units in the antenna can be reduced while a size of the antenna is ensured. In addition, because the ground plate further has the clearance area corresponding to each antenna unit, the coupling between the antenna units in the antenna can be better reduced, thereby avoiding interference between the antenna units, and ensuring performance of the antenna.

Figure 5A:
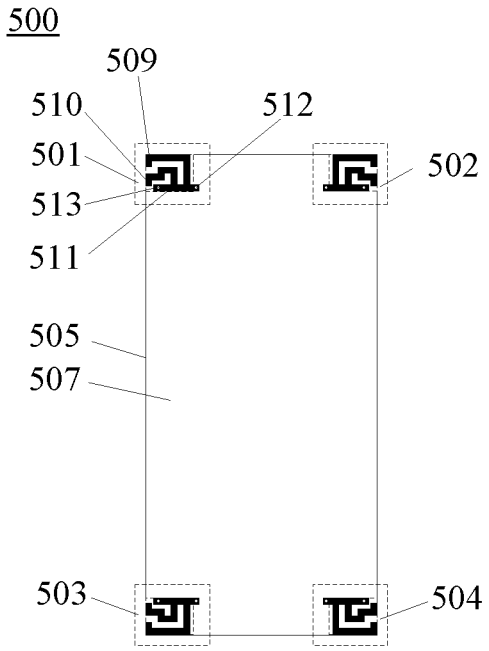
FIG. 5A is a schematic top view of a four-unit MIMO antenna according to Embodiment 3 of the present invention.
Figure 5B:
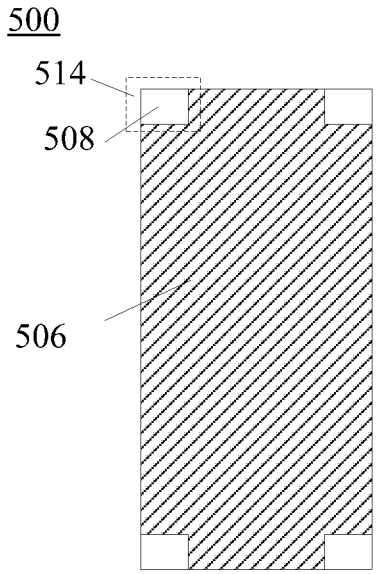
FIG. 5B is a schematic bottom view of the four-unit MIMO antenna according to Embodiment 3 of the present invention.
Figure 5C:
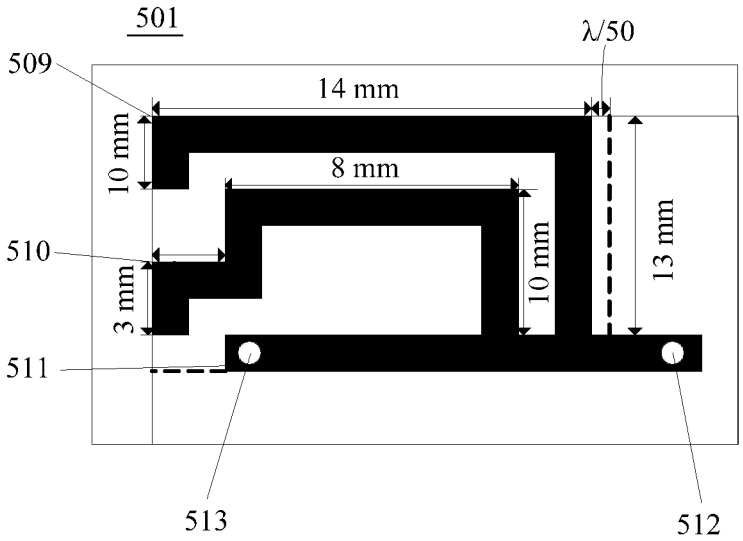
FIG. 5C is a schematic structural diagram of an antenna unit in the four-unit MIMO antenna according to Embodiment 3 of the present invention.

Embodiment 3 of the present invention further provides an antenna. Embodiment 3 of the present invention is described by using a specific example. FIG. 5A is a schematic top view of a four-unit MIMO antenna according to Embodiment 3 of the present invention. FIG. 5B is a schematic bottom view of the four-unit MIMO antenna according to Embodiment 3 of the present invention. FIG. 5C is a schematic structural diagram of an antenna unit in the four-unit MIMO antenna according to Embodiment 3 of the present invention. As shown in FIG. 5A to FIG. 5C, the antenna 500 may include a first antenna unit 501, a second antenna unit 502, a third antenna unit 503, a fourth antenna unit 504, a substrate 505, and a ground plate 506. The substrate 505 has a first surface 507 and a second surface 508. The first surface 507 and the second surface 508 are two surfaces of the substrate 505 that are parallel to each other.

The antenna units are all laid on the first surface 507 of the substrate 505, and are respectively located at four vertex positions on the first surface 507 of the substrate 505.

Each antenna unit includes a first antenna branch 509, a second antenna branch 510, and a feed branch 511. The first antenna branch 509 and the second antenna branch 510 are separately connected to the feed branch 511. A frequency band corresponding to the first antenna branch 509 may be, for example, a frequency band B39, and a frequency band corresponding to the second antenna branch 510 may be a frequency band B40. A branch length of the first antenna branch 509 may be one quarter of a wavelength corresponding to a minimum frequency in the frequency band B39. All antenna branches and feed branches are laid on the first surface 507. A first end of the feed branch 511 has a feed point 512, and a second end of the feed branch 511 has a ground point 513. All feed points 512 are connected to a feed circuit. All ground points 513 are connected to the ground plate 506. For example, the branch length of the first antenna branch 509 may be, for example, 37 mm, and a branch length of the second antenna branch 510 may be, for example, 24 mm.

If a spacing between the first antenna branch 509 and the second antenna branch 510 in each antenna unit is less than a second preset distance, the first antenna branch 509 and the second antenna branch 510 may further correspond to a common frequency band. The common frequency band may be a frequency band B38. The second preset distance may be a coupling distance corresponding to antenna branches in the same antenna unit that correspond to different frequency bands. For example, if the second preset distance is 0-2 mm, and the spacing between the first antenna branch 509 and the second antenna branch 510 may be 1 mm, the first antenna branch 509 and the second antenna branch 510 may further correspond to a common frequency band. The common frequency band may be the frequency band B38.

A distance between feed points of the first antenna unit 501 and the second antenna unit 502 is greater than or equal to $\lambda/4$ and less than $\lambda/2$; a distance between feed points of the third antenna unit 503 and the fourth antenna unit 504 is also greater than or equal to $\lambda/4$ and less than $\lambda/2$. $\lambda$ is a wavelength corresponding to a lowest frequency in a lowest frequency band corresponding to the antenna unit.

In FIG. 5A, radiation directions of antenna branches that are in the first antenna unit 501 and the second antenna unit 502 and that correspond to a same frequency band are opposite, that is, a radiation direction of the first antenna branch of the first antenna unit 501 is opposite to that of the first antenna branch of the second antenna unit 502, and a radiation direction of the second antenna branch of the first antenna unit 501 is opposite to that of the second antenna branch of the second antenna unit 502. Radiation directions of antenna branches that are in the third antenna unit 503 and the fourth antenna unit 504 and that correspond to a same frequency band are opposite, that is, a radiation direction of the first antenna branch of the third antenna unit 503 is opposite to that of the first antenna branch of the fourth antenna unit 504, and a radiation direction of the second antenna branch of the third antenna unit 503 is opposite to that of the second antenna branch of the fourth antenna unit 504. In FIG. 5A, the first antenna unit 501 is symmetrical with the third antenna unit 503, and the second antenna unit 502 is symmetrical with the fourth antenna unit 504 on the substrate 505.

The ground plate 506 has a clearance area 514 of each antenna unit. The clearance area 514 of each antenna unit is located in a projection area of the antenna unit on the ground plate 506.

A projection direction of each antenna unit on the ground plate 506 is used as a vertical direction, and a horizontal distance between a boundary that is of the feed branch 511 in each antenna unit and that is away from the antenna branch and a boundary of the clearance area 514 of the antenna unit is 0. A horizontal distance between a boundary of the first antenna branch 509 in each antenna unit and a boundary of the clearance area 514 of the antenna unit is $\lambda/50$.

Figure 6A:
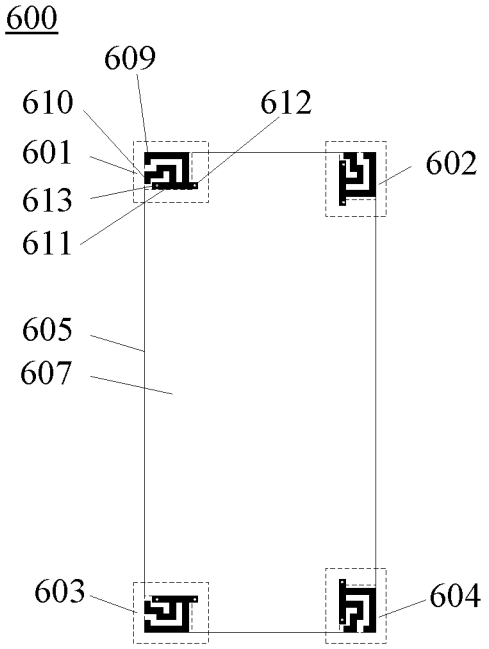
FIG. 6A is a schematic top view of another four-unit MIMO antenna according to Embodiment 3 of the present invention.
Figure 6B:
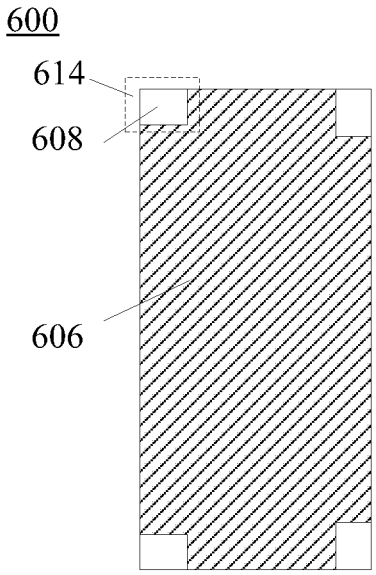
FIG. 6B is a schematic bottom view of the another four-unit MIMO antenna according to Embodiment 3 of the present invention.

Embodiment 3 of the present invention further provides another four-unit MIMO antenna. FIG. 6A is a schematic top view of another four-unit MIMO antenna according to Embodiment 3 of the present invention. FIG. 6B is a schematic bottom view of the another four-unit MIMO antenna according to Embodiment 3 of the present invention. As shown in FIG. 6A and FIG. 6B, the antenna 600 may include a first antenna unit 601, a second antenna unit 602, a third antenna unit 603, a fourth antenna unit 604, a substrate 605, and a ground plate 606. The substrate 605 has a first surface 607 and a second surface 608. The first surface 607 and the second surface 608 are two surfaces of the substrate 605 that are parallel to each other.

The antenna units are all laid on the first surface 607 of the substrate 605, and are respectively located at four vertex positions on the first surface 607 of the substrate 605.

Each antenna unit includes a first antenna branch 609, a second antenna branch 610, and a feed branch 611. The first antenna branch 609 and the second antenna branch 610 are separately connected to the feed branch 611. The first antenna branch 609 may be similar to the first antenna branch 509 in FIG. 5A, and details are not described herein again. The second antenna branch 610 may be similar to the second antenna branch 510 in FIG. 5A, and details are not described herein again. All antenna branches and feed branches are laid on the first surface 607. A first end of the feed branch 611 has a feed point 612, and a second end of the feed branch 611 has a ground point 613. All feed points 612 are connected to a feed circuit. All ground points 613 are connected to the ground plate 606.

A distance between feed points of the first antenna unit 601 and the second antenna unit 602 is greater than or equal to $\lambda/4$ and less than $\lambda/2$. A distance between feed points of the third antenna unit 603 and the fourth antenna unit 604 is also greater than or equal to $\lambda/4$ and less than $\lambda/2$. $\lambda$ is a wavelength corresponding to a lowest frequency in a lowest frequency band corresponding to the antenna unit. A radiation direction of the first antenna branch of the first antenna unit 601 is different from that of the first antenna branch of the second antenna unit 602, and a radiation direction of the second antenna branch of the first antenna unit 601 is different from that of the second antenna branch of the second antenna unit 602. A radiation direction of the first antenna branch of the third antenna unit 603 is different from that of the first antenna branch of the fourth antenna unit 604, and a radiation direction of the second antenna branch of the third antenna unit 603 is different from that of the second antenna branch of the fourth antenna unit 604. In FIG. 6A, the first antenna unit 601 is symmetrical with the third antenna unit 603, and the second antenna unit 602 is symmetrical with the fourth antenna unit 604. The feed branch of the first antenna unit 601 is perpendicular to the feed branch of the second antenna unit 602, and the feed branch of the third antenna unit 603 is perpendicular to the feed branch of the fourth antenna unit 604.

The ground plate 606 has a clearance area 614 of each antenna unit. The clearance area 614 of each antenna unit is located in a projection area of the antenna unit on the ground plate 606.

A projection direction of each antenna unit on the ground plate 606 is used as a vertical direction, and a horizontal distance between a boundary that is of the feed branch 611 in each antenna unit and that is away from the antenna branch and a boundary of the clearance area 614 of the antenna unit is 0. A horizontal distance between a boundary of the first antenna branch 709 in each antenna unit and a boundary of the clearance area 614 of the antenna unit is λ/50.

Figure 7A:
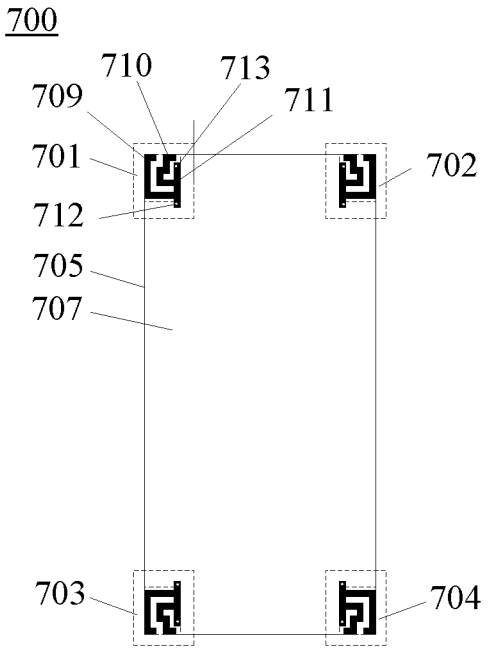
FIG. 7A is a schematic top view of still another four-unit MIMO antenna according to Embodiment 3 of the present invention.
Figure 7B:
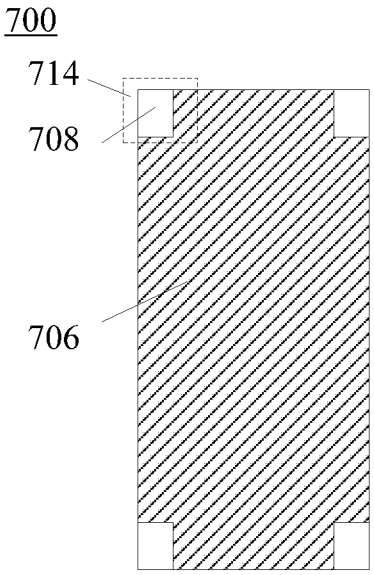
FIG. 7B is a schematic bottom view of the still another four-unit MIMO antenna according to Embodiment 3 of the present invention.

Embodiment 3 of the present invention further provides still another four-unit MIMO antenna. FIG. 7A is a schematic top view of still another four-unit MIMO antenna according to Embodiment 3 of the present invention. FIG. 7B is a schematic bottom view of the still another four-unit MIMO antenna according to Embodiment 3 of the present invention. As shown in FIG. 7A and FIG. 7B, the antenna 700 may include a first antenna unit 701, a second antenna unit 702, a third antenna unit 703, a fourth antenna unit 704, a substrate 705, and a ground plate 706. The substrate 705 has a first surface 707 and a second surface 708. The first surface 707 and the second surface 708 are two surfaces of the substrate 705 that are parallel to each other.

The antenna units are all laid on the first surface 707 of the substrate 705, and are respectively located at four vertex positions on the first surface 707 of the substrate 705.

The antenna units each include a first antenna branch 709, a second antenna branch 710, and a feed branch 711. The first antenna branch 609 and the second antenna branch 710 are separately connected to the feed branch 711. The first antenna branch 709 may be similar to the first antenna branch 509 in FIG. 5A, and details are not described herein again. The second antenna branch 710 may be similar to the second antenna branch 510 in FIG. 5A, and details are not described herein again. All antenna branches and feed branches are laid on the first surface 707. A first end of the feed branch 711 has a feed point 712, and a second end of the feed branch 711 has a ground point 713. All feed points 712 are connected to a feed circuit. All ground points 713 are connected to the ground plate 706.

In the four antenna units, a distance between feed points of the first antenna unit 701 and the second antenna unit 702 is greater than or equal to λ/4 and less than λ/2. A distance between feed points of the third antenna unit 703 and the fourth antenna unit 704 is also greater than or equal to λ/4 and less than λ/2. λ is a wavelength corresponding to a lowest frequency in a lowest frequency band corresponding to the antenna unit. A radiation direction of the first antenna branch of the first antenna unit 701 is opposite to that of the first antenna branch of the second antenna unit 702, and a radiation direction of the second antenna branch of the first antenna unit 701 is opposite to that of the second antenna branch of the second antenna unit 702. A radiation direction of the first antenna branch of the third antenna unit 703 is opposite to that of the first antenna branch of the fourth antenna unit 704, and a radiation direction of the second antenna branch of the third antenna unit 703 is opposite to that of the second antenna branch of the fourth antenna unit 704. In FIG. 7A, the feed branches of the first antenna unit 701, the second antenna unit 702, the third antenna unit 703, and the fourth antenna unit 704 are parallel to each other. In FIG. 7A, the first antenna unit 701 is symmetrical with the third antenna unit 703, and the second antenna unit 602 is symmetrical with the fourth antenna unit 604.

The ground plate 706 has a clearance area 714 of each antenna unit. The clearance area 714 of each antenna unit is located in a projection area of the antenna unit on the ground plate 706.

A projection direction of each antenna unit on the ground plate 706 is used as a vertical direction, and a horizontal distance between a boundary that is of the feed branch 711 in each antenna unit and that is away from the antenna branch and a boundary of the clearance area 714 of the antenna unit is 0. A horizontal distance between a boundary of the first antenna branch 709 in each antenna unit and a boundary of the clearance area 714 of the antenna unit is λ/50.

Figure 8A:
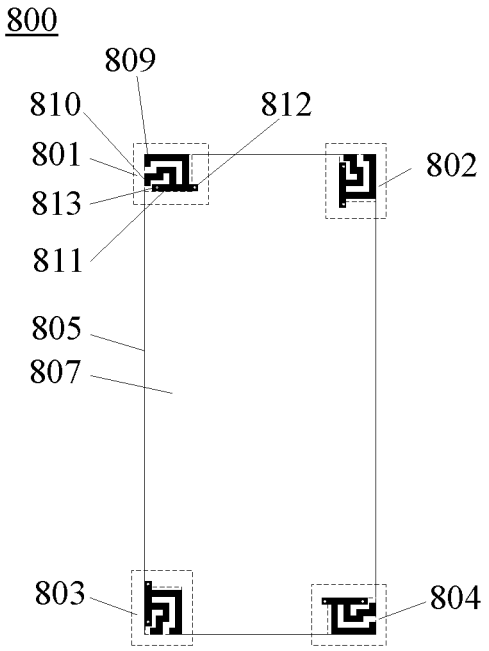
FIG. 8A is a schematic top view of yet another four-unit MIMO antenna according to Embodiment 3 of the present invention.
Figure 8B:
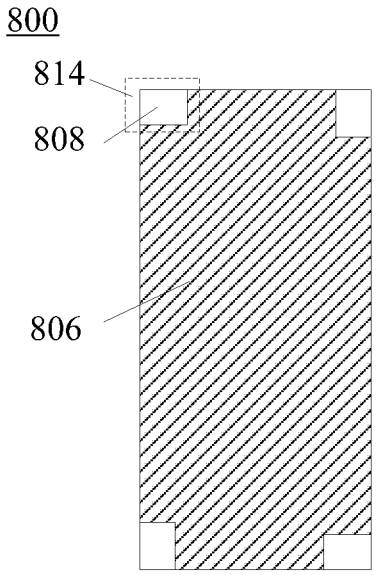
FIG. 8B is a schematic bottom view of the yet another four-unit MIMO antenna according to Embodiment 3 of the present invention.

Embodiment 3 of the present invention further provides yet another four-unit MIMO antenna. FIG. 8A is a schematic top view of yet another four-unit MIMO antenna according to Embodiment 3 of the present invention. FIG. 8B is a schematic bottom view of the yet another four-unit MIMO antenna according to Embodiment 3 of the present invention. As shown in FIG. 8A and FIG. 8B, the antenna 800 may include a first antenna unit 801, a second antenna unit 802, a third antenna unit 803, a fourth antenna unit 804, a substrate 805, and a ground plate 806. The substrate 805 has a first surface 807 and a second surface 808. The first surface 807 and the second surface 808 are two surfaces of the substrate 805 that are parallel to each other.

The antenna units are all laid on the first surface 807 of the substrate 805, and are respectively located at four vertex positions on the first surface 807 of the substrate 805.

The antenna units each include a first antenna branch 809, a second antenna branch 810, and a feed branch 811. The first antenna branch 809 and the second antenna branch 810 are separately connected to the feed branch 811. The first antenna branch 809 may be similar to the first antenna branch 509 in FIG. 5A, and details are not described herein again. The second antenna branch 810 may be similar to the second antenna branch 510 in FIG. 5A, and details are not described herein again. All antenna branches and feed branches are laid on the first surface 807. A first end of the feed branch 811 has a feed point 812, and a second end of the feed branch 811 has a ground point 813. All feed points 812 are connected to a feed circuit. All ground points 813 are connected to the ground plate 806.

A distance between feed points of the first antenna unit 801 and the second antenna unit 802 is greater than or equal to λ/4 and less than λ/2. A distance between feed points of the third antenna unit 803 and the fourth antenna unit 804 is also greater than or equal to λ/4 and less than λ/2. λ is a wavelength corresponding to a lowest frequency in a lowest frequency band corresponding to the antenna unit. A radiation direction of the first antenna branch of the first antenna unit 801 is different from that of the first antenna branch of the second antenna unit 802, and a radiation direction of the second antenna branch of the first antenna unit 801 is different from that of the second antenna branch of the second antenna unit 802. A radiation direction of the first antenna branch of the third antenna unit 803 is opposite to and different from that of the first antenna branch of the fourth antenna unit 804, and a radiation direction of the second antenna branch of the third antenna unit 803 is different from that of the second antenna branch of the fourth antenna unit 804. Feed branches of neighboring antenna units in the first antenna unit 801, the second antenna unit 802, the third antenna unit 803, and the fourth antenna unit 804 are perpendicular to each other.

The ground plate 806 has a clearance area 814 of each antenna unit. The clearance area 814 of each antenna unit is located in a projection area of the antenna unit on the ground plate 806.

A projection direction of each antenna unit on the ground plate 806 is used as a vertical direction, and a horizontal distance between a boundary that is of the feed branch 811 in each antenna unit and that is away from the antenna branch and a boundary of the clearance area 814 of the antenna unit is 0. A horizontal distance between a boundary of the first antenna branch 809 in each antenna unit and a boundary of the clearance area 814 of the antenna unit is λ/50.

For the antenna provided in Embodiment 3 of the present invention, a plurality of four-unit MIMO antennas are provided to respectively specifically describe the antennas in the foregoing embodiments, so as to better resolve a problem of coupling between antenna units in a four-unit MIMO antenna supporting a plurality of frequency bands, thereby avoiding interference between the antenna units.

Figure 9A:
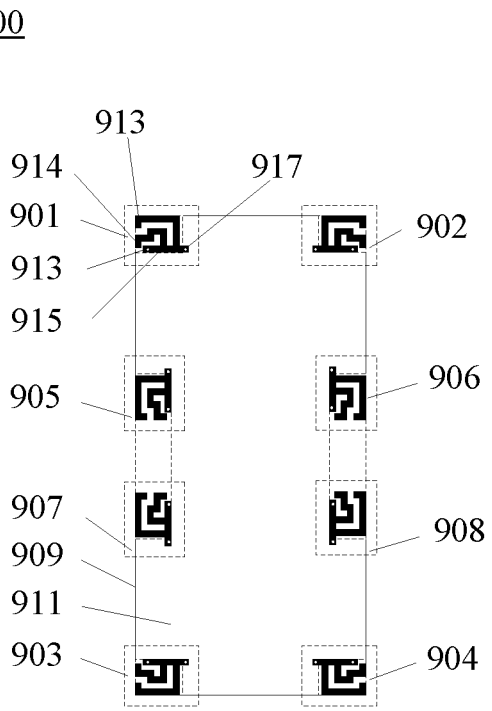
FIG. 9A is a schematic top view of an eight-unit MIMO antenna according to Embodiment 4 of the present invention.
Figure 9B:
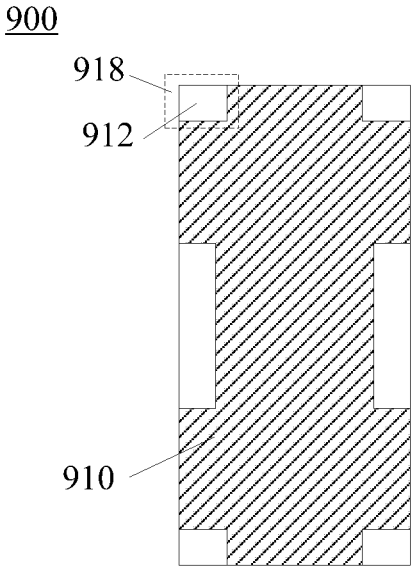
FIG. 9B is a schematic bottom view of the eight-unit MIMO antenna according to Embodiment 4 of the present invention.

Embodiment 4 of the present invention further provides an antenna. Embodiment 4 of the present invention is described by using a specific example. FIG. 9A is a schematic top view of an eight-unit MIMO antenna according to Embodiment 4 of the present invention. FIG. 9B is a schematic bottom view of the eight-unit MIMO antenna according to Embodiment 4 of the present invention. As shown in FIG. 9A and FIG. 9B, the antenna 900 may include a first antenna unit 901, a second antenna unit 902, a third antenna unit 903, a fourth antenna unit 904, a fifth antenna unit 905, a sixth antenna unit 906, a seventh antenna unit 907, an eighth antenna unit 908, a substrate 909, and a ground plate 910. The substrate 909 has a first surface 911 and a second surface 912. The first surface 911 and the second surface 912 are two surfaces of the substrate 909 that are parallel to each other.

The antenna units are all laid on the first surface 911 of the substrate 909. The first antenna unit 901, the second antenna unit 902, the third antenna unit 903, and the fourth antenna unit 904 are respectively located at four vertex positions on the first surface 911 of the substrate 909. The fifth antenna unit 905 and the seventh antenna unit 907 are located at edge positions of the first surface 911, and are on a same side as the first antenna unit 901 and the second antenna unit 902. The sixth antenna unit 906 and the eighth antenna unit 908 are located at edge positions of the first surface 911, and are on a same side as the third antenna unit 903 and the fourth antenna unit 904.

Each antenna unit includes a first antenna branch 913, a second antenna branch 914, and a feed branch 915. The first antenna branch 913 and the second antenna branch 914 are separately connected to the feed branch 915. The first antenna branch 913 may be similar to the first antenna branch 509 in FIG. 5A, and details are not described herein again. The second antenna branch 914 may be similar to the second antenna branch 510 in FIG. 5A, and details are not described herein again. All antenna branches and feed branches are laid on the first surface 911. A first end of the feed branch 915 has a feed point 916, and a second end of the feed branch 915 has a ground point 917. All feed points 916 are connected to a feed circuit. All ground points 917 are connected to the ground plate 910.

A distance between feed points of the first antenna unit 901 and the second antenna unit 902 is greater than or equal to λ/4 and less than λ/2. A distance between feed points of the third antenna unit 903 and the fourth antenna unit 904 is also greater than or equal to λ/4 and less than λ/2. A distance between feed points of the fifth antenna unit 905 and the sixth antenna unit 906 is greater than or equal to λ/4 and less than λ/2. A distance between feed points of the seventh antenna unit 907 and the eighth antenna unit 908 is also greater than or equal to λ/4 and less than λ/2. λ is a wavelength corresponding to a lowest frequency in a lowest frequency band corresponding to the antenna unit. In addition, a distance between ground points of the fifth antenna unit 905 and the seventh antenna unit 907 is λ/12, and a distance between ground points of the sixth antenna unit 906 and the eighth antenna unit 908 is λ/12.

A radiation direction of the first antenna branch of the first antenna unit 901 is opposite to that of the first antenna branch of the second antenna unit 902, and a radiation direction of the second antenna branch of the first antenna unit 901 is opposite to that of the second antenna branch of the second antenna unit 902. A radiation direction of the first antenna branch of the third antenna unit 903 is opposite to that of the first antenna branch of the fourth antenna unit 904, and a radiation direction of the second antenna branch of the third antenna unit 903 is opposite to that of the second antenna branch of the fourth antenna unit 904. A radiation direction of the first antenna branch of the fifth antenna unit 905 is opposite to that of the first antenna branch of the sixth antenna unit 906, and a radiation direction of the second antenna branch of the fifth antenna unit 905 is opposite to that of the second antenna branch of the sixth antenna unit 906. A radiation direction of the first antenna branch of the seventh antenna unit 907 is opposite to that of the first antenna branch of the eighth antenna unit 908, and a radiation direction of the second antenna branch of the seventh antenna unit 907 is opposite to that of the second antenna branch of the eighth antenna unit 908.

That is, the first antenna unit 901 is orthogonal to the second antenna unit 902, the third antenna unit 903 is orthogonal to the fourth antenna unit 904, the fifth antenna unit 905 is orthogonal to the sixth antenna unit 906, and the seventh antenna unit 907 is orthogonal to the eighth antenna unit 908. The first antenna unit 901 is further orthogonal to the fifth antenna unit 905, the second antenna unit 902 is further orthogonal to the sixth antenna unit 906, the third antenna unit 903 is further orthogonal to the seventh antenna unit 907, and the fourth antenna unit 904 is further orthogonal to the eighth antenna unit 908.

The ground plate 910 has a clearance area 918 of each antenna unit. The clearance area 918 of each antenna unit is located in a projection area of the antenna unit on the ground plate 910.

A projection direction of each antenna unit on the ground plate 910 is used as a vertical direction, and a horizontal distance between a boundary that is of the feed branch 915 in each antenna unit and that is away from the antenna branch and a boundary of the clearance area 918 of the antenna unit is 0. A horizontal distance between a boundary of the first antenna branch 913 in each antenna unit and a boundary of the clearance area 918 of the antenna unit is λ/50.

If the distance between the ground points of the fifth antenna unit 905 and the seventh antenna unit 907 is λ/12, and the distance between the ground points of the sixth antenna unit 906 and the eighth antenna unit 908 is λ/12, the ground plate 910 further has a clearance area corresponding to a separation area between the fifth antenna unit 905 and the seventh antenna unit 907 and a clearance area corresponding to a separation area between the fifth antenna unit 905 and the seventh antenna unit 907. The clearance area corresponding to the separation area between the fifth antenna unit 905 and the seventh antenna unit 907 is a projection area, on the ground plate 910, of the separation area between the fifth antenna unit 905 and the seventh antenna unit 907. The clearance area corresponding to the separation area between the sixth antenna unit 906 and the eighth antenna unit 908 is a projection area, on the ground plate 910, of the separation area between the sixth antenna unit 906 and the eighth antenna unit 908.

By means of a reduction test of the eight-unit MIMO antenna in this embodiment, it can be obtained that a return loss of antenna branches corresponding to different frequency bands in the antenna unit is less than 10 dB, isolation of the antenna branches that are in different antenna units and that correspond to the frequency bands is all less than 10 dB, and a correlation of antenna branches that are in different antenna units and that correspond to the frequency bands may be set in such a manner that transmission efficiency of an antenna branch that is in the antenna unit and that corresponds to a low frequency band is greater than 40%, and transmission efficiency of an antenna branch corresponding to a low frequency band is greater than 50%, or even 70%. Therefore, the antenna units in the antenna in Embodiment 4 of the present invention are independent of each other with little mutual interference, and transmission efficiency of antenna branch points is relatively high.

For the antenna provided in Embodiment 4 of the present invention, an eight-unit MIMO antenna is provided to respectively specifically describe the antennas in the foregoing embodiments, so as to better resolve a problem of coupling between antenna units in the eight-unit MIMO antenna supporting a plurality of frequency bands, thereby avoiding interference between the antenna units.

Figure 10:
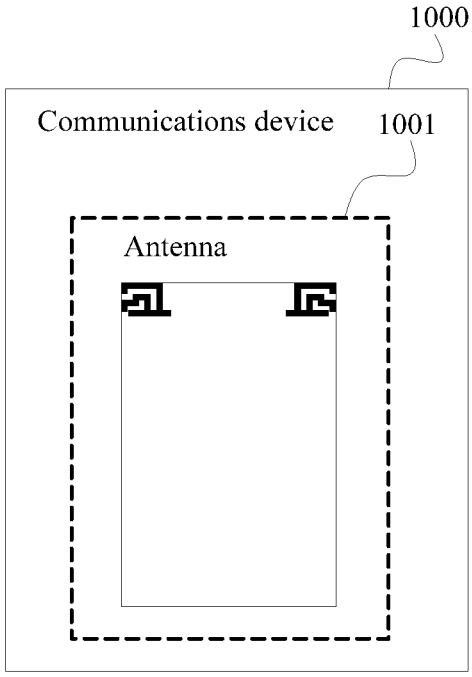
FIG. 10 is a schematic structural diagram of a communications device according to Embodiment 5 of the present invention.

Embodiment 5 of the present disclosure further provides a communications device. FIG. 10 is a schematic structural diagram of a communications device according to Embodiment 5 of the present invention. As shown in FIG. 10, the communications device 1000 may include an antenna 1001.

The antenna 1001 may be any antenna in the foregoing antenna embodiments. The antenna 1001 may include a plurality of antenna units. Each antenna unit includes a plurality of antenna branches and one feed branch. The plurality of antenna branches are all connected to the feed branch. Different antenna branches in a same antenna unit correspond to different frequency bands. At least one antenna unit pair exists in the plurality of antenna units. A distance between two antenna units in each antenna unit pair is less than a first preset distance. Radiation directions of antenna branches in each antenna unit pair that correspond to a same frequency band are different. The first preset distance is a preset distance between different antenna units.

Figure 11:
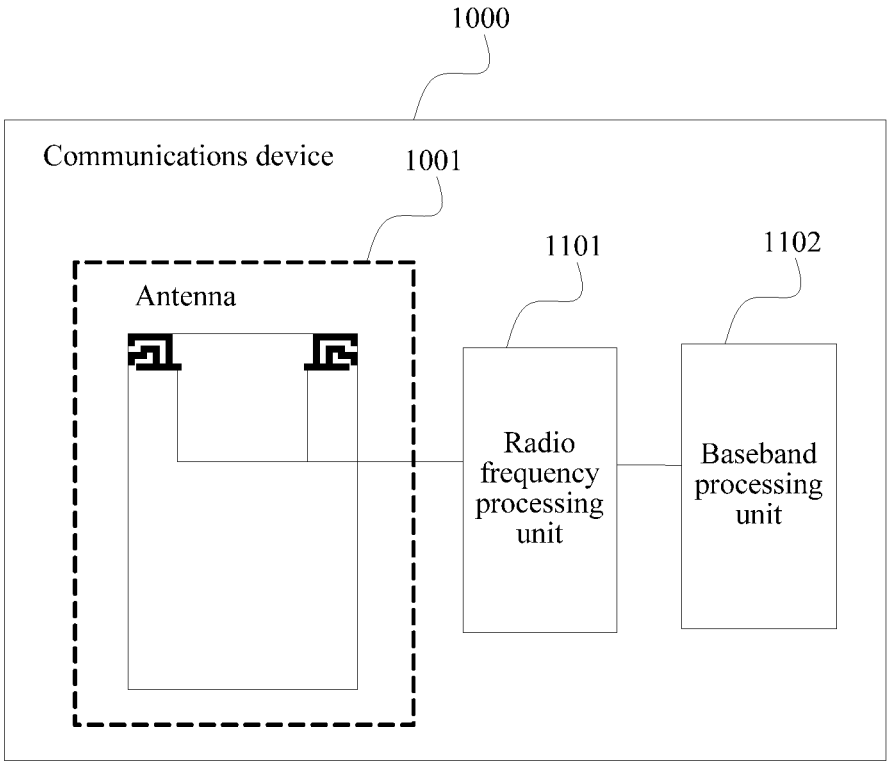
FIG. 11 is a schematic structural diagram of another communications device according to Embodiment 5 of the present invention.

FIG. 11 is a schematic structural diagram of another communications device according to Embodiment 5 of the present invention. Optionally, based on the foregoing description, the communications device 1000 may further include a radio frequency processing unit 1101 and a baseband processing unit 1102.

The baseband processing unit 1102 is connected to the feed branch by using the radio frequency processing unit 1101.

The antenna 1001 is configured to: transmit a received radio signal to the radio frequency processing unit 1101, or convert a signal transmitted by the radio frequency processing unit 1101 into an electromagnetic wave, and send the electromagnetic wave out.

The radio frequency processing unit 1101 is configured to: perform frequency selection, amplification, and down-conversion processing on the radio signal received by the antenna 1001, convert the processed radio signal into an intermediate-frequency signal or a baseband signal, and send the intermediate-frequency signal or the baseband signal to the baseband processing unit 1102; or is configured to: perform up-conversion and amplification on a baseband signal or an intermediate-frequency signal sent by the baseband processing unit 1102, and send the amplified baseband signal or intermediate-frequency signal out by using the antenna 1001.

The baseband processing unit 1102 is configured to process the intermediate-frequency signal or the baseband signal sent by the radio frequency processing unit 1101.

Optionally, the antenna 1001 may further include a substrate; the substrate has a first surface; and the plurality of antenna units are located at edge positions of the first surface.

Optionally, the antenna 1001 may further include a ground plate; the substrate further has a second surface; the second surface is parallel to the first surface; the ground plate is located on the second surface; one end of the feed branch has a feed point, and another end has a ground point; and ground points of all the antenna units are connected to the ground plate.

Optionally, the ground plate has a clearance area of each antenna unit; and the clearance area of each antenna unit is located in a projection area of the antenna unit on the ground plate.

Optionally, a projection direction of each antenna unit on the ground plate is used as a vertical direction, and a minimum horizontal distance between a boundary that is of the feed branch in each antenna unit and that is away from the antenna branch and a boundary of the clearance area of the antenna unit is 0; and a minimum horizontal distance between a boundary that is of the antenna branch in each antenna unit and that is close to the feed point and a boundary of the clearance area of the antenna unit is $\lambda/50$.

Optionally, if a distance between ground points of two neighboring antenna units in the plurality of antenna units is less than or equal to $\lambda/12$, the ground plate further has a clearance area corresponding to a separation area between the two neighboring antenna units, where the clearance area corresponding to the separation area is a projection area of the separation area on the ground plate.

Optionally, the first preset distance is $\lambda/2$, and $\lambda$ is a wavelength corresponding to a lowest frequency in a lowest frequency band corresponding to each antenna unit.

Optionally, a distance between two antenna units in each antenna unit pair is greater than or equal to $\lambda/4$ and less than $\lambda/2$.

Optionally, radiation directions of antenna branches in each antenna unit pair that correspond to a same frequency band are opposite.

Optionally, if a distance between neighboring antenna branches in a same antenna unit is less than a second preset distance, different antenna branches in the neighboring antenna branches further correspond to a common frequency band; and the common frequency band is different from a frequency band corresponding to each antenna branch in the neighboring antenna branches. The second preset distance is a coupling distance corresponding to antenna branches in the same antenna unit that correspond to different frequency bands.

In the communications device provided in Embodiment 5 of the present invention, the antenna includes a plurality of antenna units, where each antenna unit includes a plurality of antenna branches; different antenna branches in a same antenna unit correspond to different frequency bands; at least one antenna unit pair exists in the plurality of antenna units; a distance between two antenna units in each antenna unit pair is less than the first preset distance; and radiation directions of antenna branches in each antenna unit pair that correspond to a same frequency band are different. Therefore, by means of this embodiment of the present invention, coupling between antenna units of a MIMO antenna supporting a plurality of frequency bands can be improved, so as to reduce interference between the antenna units, increase isolation between the antenna units, and improve transmission efficiency of the antenna, thereby improving signal transmission efficiency of the communications device.

Finally, it should be noted that the foregoing embodiments are merely intended for describing the technical solutions of the present invention, but not for limiting the present invention. Although the present invention is described in detail with reference to the foregoing embodiments, persons of ordinary skill in the art should understand that they may still make modifications to the technical solutions described in the foregoing embodiments or make equivalent replacements to some or all technical features thereof, without departing from the scope of the technical solutions of the embodiments of the present invention.

What is claimed is:

1. An antenna, comprising:

a plurality of antenna units, each antenna unit comprising:

a plurality of antenna branches, and one feed branch; the plurality of antenna branches are all connected to the one feed branch; and different antenna branches of the plurality of antenna branches in a same antenna unit correspond to different frequency bands;

a substrate including a first surface and a second surface;

a ground plate located on the second surface; and at least one antenna unit pair exists in the plurality of antenna units, a distance between two antenna units in each antenna unit pair is less than a first preset distance, and radiation directions of antenna branches in each antenna unit pair that correspond to a same frequency band are different, wherein one end of the feed branch includes a feed point, and another end includes a ground point, and ground points of all the antenna units are connected to the ground plate.

2. The antenna according to claim 1, wherein the plurality of antenna units are located at edge positions of the first surface.

3. The antenna according to claim 1, wherein the ground plate includes a clearance area of each antenna unit; and the clearance area of each antenna unit is located in a projection area of the antenna unit on the ground plate.

4. The antenna according to claim 3, wherein a projection direction of each antenna unit on the ground plate is used as a vertical direction, and a minimum horizontal distance between a boundary that is of the feed branch in each antenna unit and that is away from the antenna branch and a boundary of the clearance area of the antenna unit is 0; and a minimum horizontal distance between a boundary that is of the antenna branch in each antenna unit and that is close to the feed point and a boundary of the clearance area of the antenna unit is λ50, wherein λ, is a wavelength corresponding to a lowest frequency in a lowest frequency band corresponding to each antenna unit.

5. The antenna according to claim 4, wherein if a distance between ground points of two neighboring antenna units in the plurality of antenna units is less than or equal to λ12, the ground plate further includes a clearance area corresponding to a separation area between the two neighboring antenna units, wherein the clearance area corresponding to the separation area is a projection area of the separation area on the ground plate.

6. A communications device, comprising:

an antenna, comprising:

a substrate including a first surface and a second surface;

a ground plate located on the second surface; and a plurality of antenna units, each antenna unit comprising:

a plurality of antenna branches, and one feed branch; the plurality of antenna branches are all connected to the one feed branch; different antenna branches of the plurality of antenna branches in a same antenna unit correspond to different frequency bands; at least one antenna unit pair exists in the plurality of antenna units; a distance between two antenna units in each antenna unit pair is less than a first preset distance; and radiation directions of antenna branches in each antenna unit pair that correspond to a same frequency band are different, wherein one end of the feed branch includes a feed point, and another end includes a ground point, and ground points of all the antenna units are connected to the ground plate.

7. The communications device according to claim 6, further comprising: a radio frequency processor and a baseband processor, wherein the baseband processor is connected to the feed branch by using the radio frequency processor;

the antenna is configured to: transmit a received radio signal to the radio frequency processor, or convert a signal transmitted by the radio frequency processor into an electromagnetic wave, and send the electromagnetic wave out;

the radio frequency processor is configured to: perform frequency selection, amplification, and down-conversion processing on the radio signal received by the antenna, convert the processed radio signal into an intermediate-frequency signal or a baseband signal, and send the intermediate-frequency signal or the baseband signal to the baseband processor; or is configured to: perform up-conversion and amplification on a baseband signal or an intermediate-frequency signal sent by the baseband processor, and send the amplified baseband signal or intermediate-frequency signal out by using the antenna; and the baseband processor is configured to process the intermediate-frequency signal or the baseband signal sent by the radio frequency processor.

8. The communications device according to claim 6, wherein the plurality of antenna units are located at edge positions of the first surface.

9. The communications device according to claim 6, wherein the ground plate includes a clearance area of each antenna unit; and the clearance area of each antenna unit is located in a projection area of the antenna unit on the ground plate.

10. The communications device according to claim 9, wherein a projection direction of each antenna unit on the ground plate is used as a vertical direction, and a minimum horizontal distance between a boundary that is of the feed branch in each antenna unit and that is away from the antenna branch and a boundary of the clearance area of the antenna unit is 0; and a minimum horizontal distance between a boundary that is of the antenna branch in each antenna unit and that is close to the feed point and a boundary of the clearance area of the antenna unit is λ50.

11. The communications device according to claim 10, wherein if a distance between ground points of two neighboring antenna units in the plurality of antenna units is less than or equal to λ12, the ground plate further includes a clearance area corresponding to a separation area between the two neighboring antenna units, wherein the clearance area corresponding to the separation area is a projection area of the separation area on the ground plate.

* * * * *